US008137125B2

(12) United States Patent
Takehara

(10) Patent No.: US 8,137,125 B2
(45) Date of Patent: Mar. 20, 2012

(54) CONDUCTOR CONNECTION STRUCTURE

(75) Inventor: Hideaki Takehara, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 109 days.

(21) Appl. No.: 12/656,233

(22) Filed: Jan. 21, 2010

(65) Prior Publication Data

US 2010/0216356 A1 Aug. 26, 2010

(30) Foreign Application Priority Data

Feb. 26, 2009 (JP) ..... 2009-044269
Feb. 26, 2009 (JP) ..... 2009-044270

(51) Int. Cl.
*H01R 4/50* (2006.01)

(52) U.S. Cl. ..... 439/427; 439/263; 439/930; 174/94 S

(58) Field of Classification Search ..... 439/427–429, 439/263, 930, 790, 863; 174/94 R, 94 S
See application file for complete search history.

(56) References Cited

U.S. PATENT DOCUMENTS

| | | | | | |
|---|---|---|---|---|---|
| 1,583,697 | A | * | 5/1926 | Latham | 439/732 |
| 3,019,410 | A | * | 1/1962 | Logan et al. | 439/848 |
| 3,088,086 | A | * | 4/1963 | Crimmins | 439/492 |
| 3,094,365 | A | * | 6/1963 | Chamberlain et al. | 439/263 |
| 3,538,486 | A | * | 11/1970 | Shlesinger, Jr. | 439/268 |
| 3,761,870 | A | * | 9/1973 | Drezin et al. | 439/584 |
| 3,810,074 | A | * | 5/1974 | Brandenburg, Jr. | 439/427 |
| 4,392,703 | A | * | 7/1983 | Hall et al. | 439/291 |
| 4,929,191 | A | * | 5/1990 | Dufresne | 439/429 |
| 5,615,674 | A | * | 4/1997 | Maurer | 600/372 |
| 6,039,614 | A | * | 3/2000 | Ramari | 439/843 |
| 7,226,308 | B1 | * | 6/2007 | Hanks | 439/427 |
| 7,500,868 | B2 | * | 3/2009 | Holland et al. | 439/429 |
| 7,828,572 | B1 | * | 11/2010 | Liu | 439/270 |
| 2010/0216356 | A1 | * | 8/2010 | Takehara | 439/863 |
| 2011/0104929 | A1 | * | 5/2011 | Suzuki et al. | 439/345 |

FOREIGN PATENT DOCUMENTS

| | | |
|---|---|---|
| JP | 2008-103152 | 5/2008 |
| JP | 2008-103153 | 5/2008 |
| JP | 2008-123997 | 5/2008 |

* cited by examiner

*Primary Examiner* — Neil Abrams
(74) *Attorney, Agent, or Firm* — McGinn IP Law Group PLLC

(57) ABSTRACT

A conductor connection structure includes a cable including a stranded conductor composed of twisted plural wire conductors, and an insulating layer formed around the perimeter of the stranded conductor, the cable being connected to a male terminal member; a female terminal including a protruding portion formed by causing the stranded conductor to protrude from the insulating layer at an end of the cable, the female terminal being formed in a cylindrical shape by widening the center of an end of the protruding portion to make the protruding portion hollow, to insert the male terminal member into the protruding portion; and a fastening member slidably provided around the perimeter of the female terminal, to tighten the female terminal when connected to the male terminal member, to fasten the male terminal member.

23 Claims, 10 Drawing Sheets

| | |
|---|---|
| 1 FEMALE TERMINAL CABLE | 8 FASTENING MEMBER |
| 2 WIRE CONDUCTORS | 9 SLITS |
| 3 STRANDED CONDUCTOR | 10 MALE TERMINAL CABLE |
| 4 INSULATING LAYER | 11 MALE TERMINAL |
| 5 FEMALE TERMINAL | 15 PIN TERMINAL |
| 6 CABLE | 16 CONDUCTOR PIN |
| 7 PROTRUDING PORTION | |

| | |
|---|---|
| 5 FEMALE TERMINAL | 21 FEMALE TERMINAL MOLD |
| 5a CYLINDRICAL PORTION | 22 PUSHER MEMBER |
| 5b HOLLOW PORTION | |
| 5c TAPERED BASE | |

| | |
|---|---|
| 1 FEMALE TERMINAL CABLE | 10 MALE TERMINAL CABLE |
| 5 FEMALE TERMINAL | 11 MALE TERMINAL |

51 CONDUCTOR CONNECTION STRUCTURE

5a CYLINDRICAL PORTION
5b HOLLOW PORTION
61 FEMALE TERMINAL CABLE
62 STOPPER
71 FEMALE TERMINAL CABLE

| | |
|---|---|
| 101 FEMALE TERMINAL CABLE | 107 PROTRUDING PORTION |
| 102 WIRE CONDUCTORS | 110 MALE TERMINAL CABLE |
| 103 STRANDED CONDUCTOR | 111 MALE TERMINAL |
| 104 INSULATING LAYER | 115 PIN TERMINAL |
| 105 FEMALE TERMINAL | 116 CONDUCTOR PIN |

| | |
|---|---|
| 105 FEMALE TERMINAL | 121 FEMALE TERMINAL MOLD |
| 105a CYLINDRICAL PORTION | 122 PUSHER MEMBER |
| 105b HOLLOW PORTION | |
| 105cTAPERED BASE | |

| |
|---|
| 101 FEMALE TERMINAL CABLE |
| 110 MALE TERMINAL CABLE |
| 111 MALE TERMINAL |
| 131 CONDUCTOR CONNECTION STRUCTURE |

141 FEMALE TERMINAL CABLE
142 SLITS
143 MALE TERMINAL CABLE
144 PIN TERMINAL

151 FEMALE TERMINAL CABLE
152 SPRING
153 MALE TERMINAL CABLE
154 PIN TERMINAL

161 FEMALE TERMINAL CABLE
162 FEMALE TERMINAL
163 SPRING
164 MALE TERMINAL CABLE
165 MALE TERMINAL
167 PIN TERMINAL

101 FEMALE TERMINAL CABLE
105 FEMALE TERMINAL
106 CABLE
115 PIN TERMINAL
171 CONNECTOR
173 MALE HOUSING
174 MALE CONNECTOR
175 FEMALE HOUSING
176 FEMALE CONNECTOR
177 LEVER

CONDUCTOR CONNECTION STRUCTURE

The present application is based on Japanese patent application Nos. 2009-044269 and 2009-044270 filed on Feb. 26, 2009, the entire contents of which are incorporated herein by reference.

BACKGROUND OF THE INVENTION

1. Field of the Invention

The present invention relates to a conductor connection structure, which is specially designed to be used in hybrid vehicles, electric vehicles, and the like.

2. Description of the Related Art

Conventionally, as a conductor connection structure for electrically connecting cable (insulated cable) conductors together, there is known a terminal connection type conductor connection structure which mates male and female terminals provided at ends of one cable and the other, respectively, to thereby electrically connect their respective conductors together.

Also, as a conductor connection structure used in joints of large-capacity cables such as power cables (power electric cables), there is known a terminal connection type conductor connection structure which mates a male pin terminal to a female socket terminal provided at ends of cables, respectively.

Refer to JP-A-2008-103152, JP-A-2008-103153, and JP-A-2008-123997, for example.

With the conventional terminal connection type conductor connection structures, however, there is the problem that the mating male and female terminal portion tends to be larger than the outside diameter of the cables. This increases the size of the connecting portion, to cause difficulty in size reduction of, especially, the portion connecting plural cables to other cables (or pin terminals).

Further, there is the problem of the increasing number of parts due to requirements for connecting the terminals to the conductors of the cables, respectively.

Also, using the cable connection portion in a vibrational environment, such as a hybrid vehicle, an electric vehicle, or the like, requires removal of the vibrational effect on the cable connection portion. To remove such vibration, it has been suggested to provide a spring around the perimeter of the female terminal, to firmly secure the male and female terminals.

However, there is the problem that the vibration-resistant spring accelerates wear in the contact portion caused by terminal insertion/removal.

SUMMARY OF THE INVENTION

Accordingly, it is an object of the present invention to provide a conductor connection structure, which obviates the above problems, thereby ensuring reduction in the size of its portion connecting conductors together, and in the number of parts, and inhibiting wear in the contact portion of the conductors caused by terminal insertion/removal.

And, it is another object of the present invention to provide a conductor connection structure, which obviates the above problems, thereby ensuring reduction in the size of its portion connecting conductors together, and in the number of parts.

(1) According to one embodiment of the invention, a conductor connection structure comprises:

a cable comprising a stranded conductor comprising twisted plural wire conductors, and an insulating layer formed around the perimeter of the stranded conductor, the cable being connected to a male terminal member;

a female terminal comprising a protruding portion formed by causing the stranded conductor to protrude from the insulating layer at an end of the cable, the female terminal being formed in a cylindrical shape by widening the center of an end of the protruding portion to make the protruding portion hollow, to insert the male terminal member into the protruding portion; and a fastening member slidably provided around the perimeter of the female terminal, to tighten the female terminal when connected to the male terminal member, to fasten the male terminal member.

In the above embodiment (1), the following modifications and changes can be made.

(i) The female terminal includes a cylindrical portion at the end of the protruding portion cylindrically molded by diametrically widening the stranded conductor at the end of the protruding portion, and the cylindrical portion is formed with plural slits in its axial direction, which circumferentially split the cylindrical portion.

(ii) An even number of the slits are formed to circumferentially and equally split the cylindrical portion.

(iii) The cylindrical portion of the female terminal is formed to be widened toward its end.

(iv) The inner wall of the fastening member is formed in a tapered shape, which is widened toward the end of the female terminal.

(v) The female terminal is formed by arranging a female terminal mold around the protruding portion, and pushing a pusher member with a pointed protrusion into the end of the protruding portion to widen the plural wire conductors of the protruding portion outward, so that the female terminal is molded by the pressure between the female terminal mold and the pusher member.

(vi) The cylindrical portion of the female terminal is formed to be widened toward its end by widening its end outward after the pressure molding.

(vii) The female terminal is formed by widening outward and pressure molding the plural wire conductors of the protruding portion, and subsequently adhering a conductive metal.

(viii) The female terminal is formed by adhering a conductive metal to the plural wire conductors at the end of the stranded conductor, and subsequently widening outward and pressure molding the plural wire conductors.

(ix) The fastening member is formed of the same material as the stranded conductor, or stainless.

(x) The male terminal member is a pin terminal.

(xi) The male terminal member comprises a cable comprising a stranded conductor comprising twisted plural wire conductors, and an insulating layer formed around the perimeter of the stranded conductor, and a male terminal with a protruding portion formed by causing the stranded conductor to protrude from the insulating layer at the end of the cable, and diametrically compressing the end of the protruding portion, to mate the protruding portion to the female terminal.

(2) According to another embodiment of the invention, a conductor connection structure comprises:

a cable comprising a stranded conductor comprising twisted plural wire conductors, and an insulating layer formed around the perimeter of the stranded conductor, the cable being connected to a male terminal member; and a female terminal comprising a protruding portion formed by causing the stranded conductor to protrude from the insulating layer at an end of the cable, the female terminal being formed in a cylindrical shape by widening the center of an end of the protruding portion to make the protruding portion hollow, to insert the male terminal member into the protruding portion.

In the above embodiment (2), the following modifications and changes can be made.

(i) The female terminal is formed by arranging a female terminal mold around the protruding portion, and pushing a pusher member with a pointed protrusion into the end of the protruding portion to widen the plural wire conductors of the protruding portion outward, so that the female terminal is molded by the pressure between the female terminal mold and the pusher member.

(ii) The female terminal includes a cylindrical portion at the end of the protruding portion cylindrically molded by diametrically widening the stranded conductor at the end of the protruding portion, and the cylindrical portion is formed with plural slits in its axial direction, which circumferentially split the cylindrical portion.

(iii) An even number of the slits are formed to circumferentially and equally split the cylindrical portion.

(iv) The female terminal is formed by widening outward and pressure molding the plural wire conductors of the protruding portion, and subsequently adhering a conductive metal.

(v) The female terminal is formed by adhering a conductive metal to the plural wire conductors at the end of the stranded conductor, and subsequently widening outward and pressure molding the plural wire conductors.

(3) According to another embodiment of the invention, a conductor connection structure comprises:

a cable comprising a stranded conductor comprising twisted plural wire conductors, and an insulating layer formed around the perimeter of the stranded conductor, the cable being connected to a male terminal member; and a female terminal comprising a protruding portion formed by causing the stranded conductor to protrude from the insulating layer at an end of the cable, the female terminal being formed by splitting the protruding portion into two to be formed into a clevis shape, to insert the male terminal member into the protruding portion.

In the above embodiment (3), the following modifications and changes can be made.

(i) The female terminal is formed with the two clevis terminal portions, each being formed to have a rectangular cross-sectional shape.

(ii) The conductor connection structure further comprises a spring provided around the perimeter of the female terminal to inhibit the female terminal from being widened outward when inserting the male terminal member.

(iii) The spring is formed of the same material as the stranded conductor, or stainless.

(iv) The male terminal member is a pin terminal.

(v) The male terminal member comprises a cable comprising a stranded conductor comprising twisted plural wire conductors, and an insulating layer formed around the perimeter of the stranded conductor, and a male terminal with a protruding portion formed by causing the stranded conductor to protrude from the insulating layer at the end of the cable, and diametrically compressing the end of the protruding portion, to mate the protruding portion to the female terminal.

POINTS OF THE INVENTION

In one embodiment of the invention, a stranded conductor of cable is converted into a terminal to form a female terminal cable, so that no conventional terminal used is required, and the connection portion of the conductors (the connection portion of the female terminal and male terminal member) can therefore be smaller than the outside diameter of the cable, thus ensuring the size reduction of the connection portion. Also, because of no terminal required, it can be ensured that the number of parts is reduced, thereby allowing a reduction in production cost. Further, reduction in the size and the number of parts can ensure the weight reduction of the conductor connection structure. Also, because of no terminal required, the increase of the connection resistance caused in the connection portion of the stranded conductor and the terminal, and therefore heat generation in the connection portion can be inhibited. Further, a slidable fastening member may be provided around the perimeter of the female terminal to tighten the female terminal only when connected to the male terminal member, so that the wear in the contact portion caused by the insertion/removal of the male terminal member can be inhibited, and the male terminal can securely be fixed into the female terminal. This can realize the conductor connection structure whose connection portion is not adversely affected by vibration, and whose contact portion is not worn during insertion/removal. Thus, this conductor connection structure is suitable for conductor connection structure for electric cables used in vibrational environments, such as vehicles.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

First embodiment

Below is described a conductor connection structure in the first embodiment according to the invention, referring to FIGS. 1A-1F, 2A-2C, 3A, 3B, 4A, 4B, 5A and 5B.

A conductor connection structure of the invention is for connecting a cable to a male terminal member (another cable or a pin terminal), and is used in, for example, large-current wire harness connectors for use in hybrid vehicles, electric vehicles, and the like.

Female Terminal Cable 1

Figure 1A:
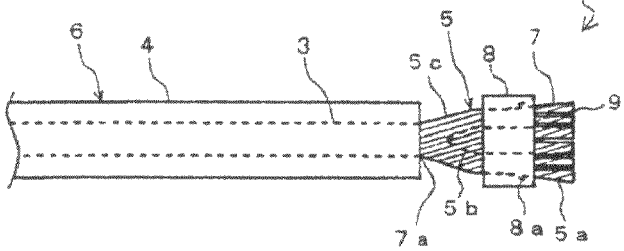
FIG. 1A is a front view showing a female terminal cable used in a conductor connection structure in a first embodiment according to the invention.
Figure 1B:
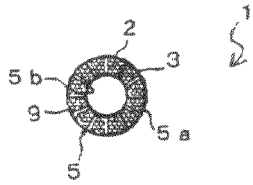
FIG. 1B is a side end face view showing the female terminal cable of FIG. 1A.

FIG. 1A is a front view showing a female terminal cable used in the conductor connection structure of the first embodiment. FIG. 1B is a side end face view showing the female terminal cable of FIG. 1A.

As shown in FIGS. 1A and 1B, a female terminal cable 1 comprises a cable 6, a female terminal 5 formed integrally with an end of the cable 6, and a fastening member (spring) 8 provided slidably around the perimeter of the female terminal 5.

Cable 6

The cable 6 comprises a stranded conductor 3 comprising twisted plural wire conductors 2, and an insulating layer 4 formed around the perimeter of the stranded conductor 3.

It is desirable that the stranded conductor 3 of the cable 6 uses twisted multiple wire conductors 2, i.e., at least 20, preferably 50 or more twisted wire conductors 2. The wire conductors 2 to use may have a diameter ø of substantially 0.1-1.0 mm, for example. It is desirable that the stranded conductor 3 has a diameter of 4.0-10 mm, for example, and that the entire stranded conductor 3 is rigid.

The wire conductors 2 are formed of copper, a copper alloy, aluminum, an aluminum alloy, or the like. The insulating layer 4 is formed of a rubber material, or a plastic material. Although in FIGS. 1A and 1B, the insulating layer 4 is formed by one layer, it may have a multilayer structure.

Female Terminal 5

The female terminal 5 is for inserting and mating a later-described male terminal member, and is formed of a protruding portion 7 of the stranded conductor 3. The female terminal 5 comprises a cylindrical portion 5*a* at an end of the protruding portion 7 cylindrically molded by diametrically widening the protruding portion 7 of the stranded conductor 3, and a tapered base 5*c* between a base end 7*a* of the protruding portion 7 at the boundary between the protruding portion 7 and the insulating layer 4, and the cylindrical portion 5*a*. The tapered base 5*c* is diametrically and gradually widened from the base end 7*a*. At the end of the female terminal 5 is formed a hollow portion 5*b* enclosed with the cylindrical portion 5*a*. Also, the cylindrical portion 5*a* of the female terminal 5 is formed to be widened toward its end.

Slits 9

The cylindrical portion 5*a* of the female terminal 5 is formed with plural slits 9 in its axial direction, which circumferentially split the cylindrical portion 5*a*.

It is preferred to form an even number of the slits 9 to circumferentially and equally split the cylindrical portion 5*a*. This allows the respective inner surfaces of the split cylindrical portions 5*a* to be located directly opposite each other with respect to the male terminal member (or the hollow portion 5*b*), and therefore the female terminal 5 and the male terminal member to firmly mate to each other. Also, the slits 9 are located directly opposite each other with respect to the male terminal member (or the hollow portion 5*b*), and can therefore inhibit the male terminal member from fitting into the slit 9 and deforming the female terminal 5.

Fastening Member 8

The female terminal 5 is provided with the fastening member 8 slidable therearound. The fastening member 8 is for tightening the female terminal 5 to fasten the male terminal member when connecting the female terminal 5 and the male terminal member, and is formed in an annular shape, or formed to have a C-shape in its transverse cross-section. This embodiment explains the use of an annular fastening member 8. The inner wall (inner peripheral surface) 8*a* of the annular fastening member 8 is formed in a tapered shape, which is widened toward the end of the female terminal 5.

It is desirable that the fastening member 8 uses a high-conductivity material. To prevent hetero-metal contact corrosion, the fastening member 8 may use the same material as the stranded conductor 3. For example, where the stranded conductor 3 is formed of copper or a copper alloy, the fastening member 8 may use copper or a copper alloy. Where the stranded conductor 3 is formed of aluminum or an aluminum alloy, the fastening member 8 may use aluminum or an aluminum alloy.

Also, because in the case of use of, especially, a C-shape-cross-sectional fastening member 8, its use in an environment of large amounts of heat generated, as in large current cables and the like, causes its elastic force to be weakened and its contact resistance to be increased by stress relaxation due to heat, it is preferred that the fastening member 8 uses an elastic iron-based alloy, such as stainless, from the point of view of long-term maintenance of its elasticity. In this manner, the material to use as the fastening member 8 may be determined appropriately according to purposes of use, materials used as the stranded conductor 3, etc.

Female Terminal Cable 1-Producing Process

Figure 2A:
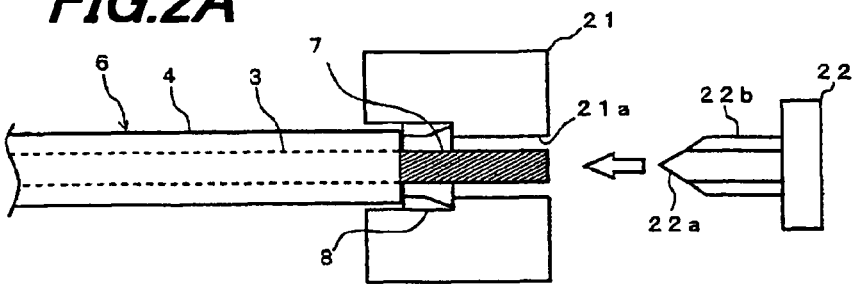
FIGS. 2A-2C are diagrams showing a process for producing the female terminal cable of FIG. 1A.

Referring to FIG. 2A, the female terminal cable 1 is produced as follows: At an end of cable 6, the stranded conductor 3 is first caused to protrude from insulating layer 4 to form the protruding portion 7. Around the protruding portion 7 is arranged a female terminal mold 21. In this case, it is preferred to pass beforehand the fastening member 8 around the protruding portion 7. The length of the protruding portion 7 of the stranded conductor 3 protruding from the end of cable 6 is 15 to 20 mm, for example.

The female terminal mold 21 is formed with a female terminal mold hole 21*a* with a substantially constant inner diameter. In the female terminal mold hole 21*a* is arranged the protruding portion 7.

Figure 2B:
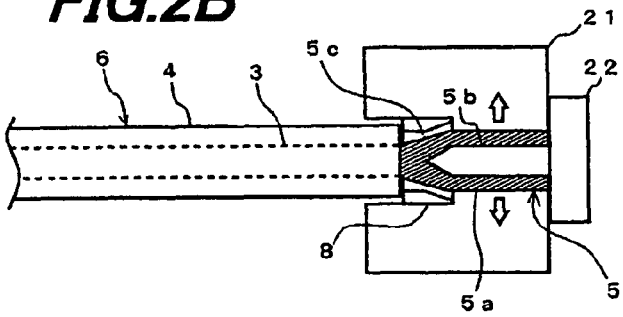

Referring to FIG. 2B, a pusher member 22 with a pointed protrusion 22*a* is subsequently pushed into the end of the protruding portion 7, to widen the center of the end of the protruding portion 7 to make the protruding portion 7 hollow, and cause the pressure between the female terminal mold 21 and the pusher member 22 to mold the protruding portion 7, to form the female terminal 5 including the hollow portion 5*b* in the protruding portion 7. The pointed protrusion 22*a* of the pusher member 22 is formed to be sized equal to or smaller than a later-described male terminal member outside diameter (i.e., an outside diameter of its portion to be inserted into and mated to the hollow portion 5*b*).

Figure 3A:
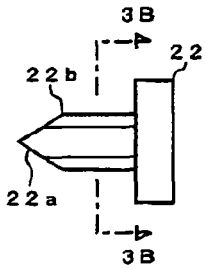
FIG. 3A is a longitudinal sectional view showing a pusher member used in producing the female terminal cable.
Figure 3B:
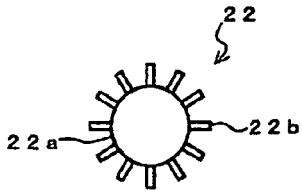
FIG. 3B is a cross-sectional view showing the pusher member taken along line 3B-3B of FIG. 3A.

Referring to FIGS. 3A and 3B, the perimeter of the pointed protrusion 22*a* of the pusher member 22 is axially formed with slit formation protrusions 22*b*, which are for forming slits 9 simultaneously when the stranded conductor 3 is molded by pressure to form the female terminal 5. Although the stranded conductor 3 comprises the twisted plural wire conductors 2, because the protruding portion of the stranded conductor 3 is short and substantially straight, the slits 9 can be molded by inserting into the protruding portion of the stranded conductor 3 the pusher member 22 formed with the slit formation protrusions 22*b*.

Figure 2C:
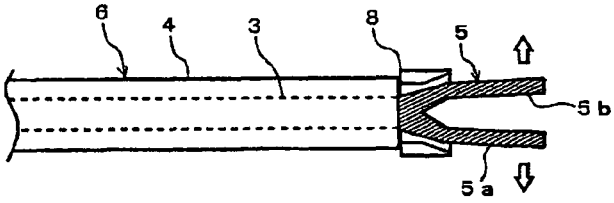

Referring to FIG. 2C, the female terminal mold 21 and the pusher member 22 are subsequently removed, to widen the end of the cylindrical portion 5*a* outward. This widens the slits 9, and thereby forms the wide-ended cylindrical portion 5*a*. The outside diameter ø of the cylindrical portion 5*a* prior to the wide-end shaping is 10 mm, for example, its inside diameter is ø 5 mm, for example, and its length (mating length) in the axial direction of the hollow portion 5*b* is 10 mm, for example.

This results in the female terminal cable 1, as shown in FIGS. 1A and 1B.

Although herein has been explained the example of widening the end of the cylindrical portion 5*a* outward after the pressure molding of the female terminal 5, the wide-end molding of the cylindrical portion 5*a* may be done during the pressure molding of the female terminal 5.

Also, to reinforce the mechanical strength of the female terminal 5, a conductive metal may be adhered to the female terminal 5. As the conductive metal to adhere, there is nickel, a nickel alloy, silver, a silver alloy, tin, a tin alloy (e.g., solder), gold, a gold alloy, platinum, a platinum alloy, copper, a copper alloy, aluminum, an aluminum alloy, zinc, a zinc alloy, or the like.

When adhering the conductive metal to the female terminal 5, after the pressure molding of the female terminal 5, with the pusher member 22 pushed in, the female terminal 5 is immersed in the conductive metal melt to adhere the conductive metal. This may be followed by widening the end of the cylindrical portion 5*a*. Although herein has been explained the example of adhering the conductive metal after forming the female terminal 5, the conductive metal may first be adhered to the protruding portion 7 of the stranded conductor 3, and the female terminal 5 may then be formed by pressure molding.

Male Terminal Member

Figure 1C:
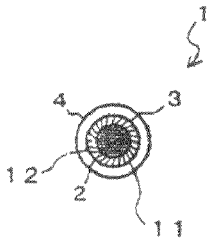
FIG. 1C is a side end face view showing a male terminal cable used in the conductor connection structure in the first embodiment.
Figure 1D:
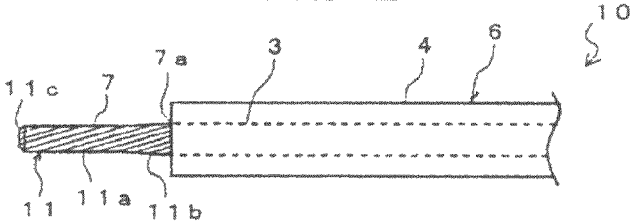
FIG. 1D is a front view showing the male terminal cable of FIG. 1C.
Figure 1E:
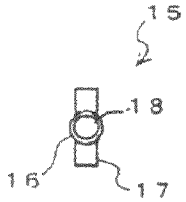
FIG. 1E is a side end face view showing a pin terminal used in the conductor connection structure in the first embodiment.
Figure 1F:
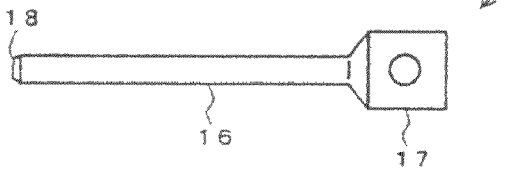
FIG. 1F is a front view showing the pin terminal of FIG. 1E.

A male terminal member to be connected to the female terminal 5 of the female terminal cable 1 of FIGS. 1A and 1B uses a male terminal cable 10 as shown in FIGS. 1C and 1D, or a pin terminal 15 as shown in FIGS. 1E and 1F.

The male terminal cable 10 shown in FIGS. 1C and 1D comprises a cable 6 including a stranded conductor 3 comprising twisted plural wire conductors 2, and an insulating layer 4 formed around the perimeter of the stranded conductor 3, and a male terminal 11 formed by molding the stranded conductor 3 at an end of the cable 6. Although herein is explained the cable 6 of the male terminal cable 10 using the same as that of the female terminal cable 1, the cable 6 may be different therefrom in dimensions.

The male terminal 11 is formed with a protruding portion 7 formed by causing the stranded conductor 3 to protrude from the insulating layer 4 at the end of the cable 6, and diametrically compressing the end of the protruding portion 7. The length of the protruding portion 7 of the stranded conductor 3 protruding from the end of the cable 6 is 15 to 20 mm, for example.

The male terminal 11 comprises a terminal portion 11*a* at a diametrically compressed end of the protruding portion 7, and a tapered base 11*b* between a base end 7*a* of the protruding portion 7 at the boundary between the protruding portion 7 and the insulating layer 4, and the terminal portion 11*a*. The tapered base 11*b* is diametrically and gradually compressed from the base end 7*a*. Also at the end of the terminal portion 11*a* of the male terminal 11 is formed a tapered terminal end 11*c*, which is diametrically compressed toward the end of the male terminal 11, to facilitate the insertion of the male terminal 11 into the female terminal 5. The outside diameter a of the terminal portion 11*a* of the male terminal 11 is 5 mm, for example.

Conductor Connection Structure

Figure 4A:
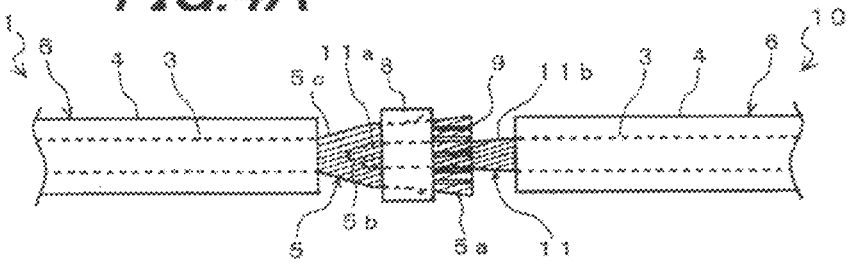
FIG. 4A is a front view showing the conductor connection structure prior to fastening in the first embodiment.
Figure 4B:
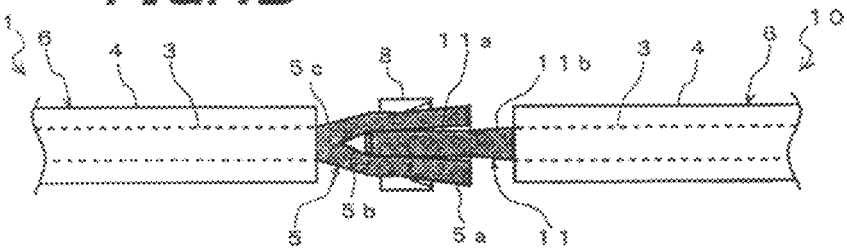
FIG. 4B is a longitudinal sectional view showing the conductor connection structure of FIG. 4A.

Referring to FIGS. 4A and 4B, the male terminal cable 10 is connected to the female terminal cable 1 as follows: First, with the fastening member 8 slid backward (opposite the male terminal cable 10), the terminal portion 11*a* of the male terminal 11 of the male terminal cable 10 is inserted into the hollow portion 5*b* of the female terminal 5 of the female terminal cable 1. The wide-ended shape of the cylindrical portion 5*a* of the female terminal 5 allows the terminal portion 11*a* of the male terminal 11 to be inserted into the hollow portion 5*b* easily and without wear in contact portion.

Figure 5A:
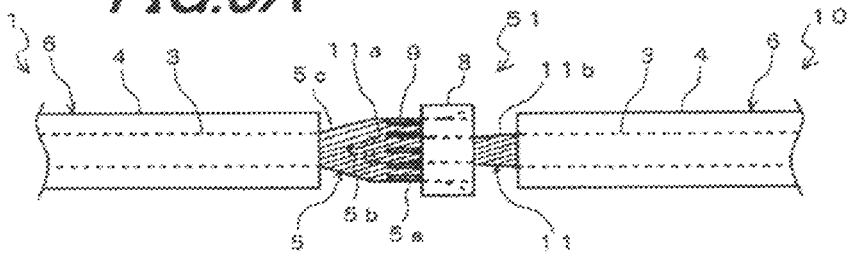
FIG. 5A is a front view showing the conductor connection structure after fastening in the embodiment.
Figure 5B:
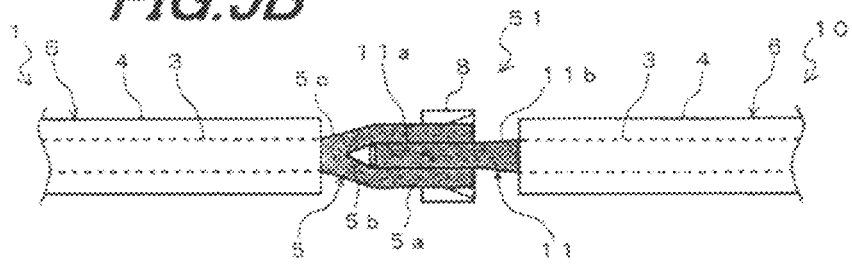
FIG. 5B is a longitudinal sectional view showing the conductor connection structure of FIG. 5A.

Referring to FIGS. 5A and 5B, the fastening member 8 is subsequently slid forward (toward the male terminal cable 10). Slits 9 are then narrowed to diametrically compress the cylindrical portion 5*a* to fasten the male terminal 11 into the female terminal 5. This results in a conductor connection structure 51 of the invention electrically connecting the stranded conductor 3 of the female terminal cable 1 and the stranded conductor 3 of the male terminal cable 10. The fastening strength is adjustable by, when using the annular fastening member 8, adjusting the inner diameter (minimum inner diameter) of the fastening member 8, and by, when using the C-shape-cross-sectional fastening member 8, adjusting the inner diameter (minimum inner diameter) of the fastening member 8 or appropriately selecting a material for the fastening member 8 to adjust its elasticity.

The fastening is released by sliding the fastening member 8 backward to widen the cylindrical portion 5*a* outward, thereby allowing the male terminal 11 to be pulled and removed from the female terminal 5 easily and without wear in contact portion.

Also, the connection portion of the female terminal cable 1 and the male terminal cable 10 may be wrapped with an insulating tape or the like, or provided with a casing or the like, to protect the connection portion.

The pin terminal 15 shown in FIGS. 1E and 1F comprises a conductive pin 16 to mate to the female terminal of the female terminal cable 1, and a terminal portion 17 for an external electric equipment formed integrally with the conductive pin 16 and to connect to the external electric equipment. Also at the end of the conductive pin 16 is formed a tapered terminal end 18, which is diametrically compressed toward the end of the conductive pin 16, to facilitate the insertion of the pin terminal 15 into the female terminal 5. The pin terminal 15 is formed of copper, a copper alloy, aluminum, or an aluminum alloy, for example.

When using the pin terminal 15 as the male terminal member, the conductive pin 16 of the pin terminal 15 is inserted and mated into the hollow portion 5*b* of the female terminal 5 of the female terminal cable 1, for electrical connection, in the same manner as when using male terminal cable 10.

Functions and Advantages

Functions and advantages of this embodiment are explained below.

In the conductor connection structure of this embodiment, at the end of the cable 6 of the female terminal cable 1, the stranded conductor 3 is first caused to protrude from the insulating layer 4 to form the protruding portion 7. The protruding portion 7 is widened at the center of its end to make the protruding portion 7 hollow, and thereby form the cylindrical female terminal 5 for the male terminal member being inserted thereinto. Around the perimeter of the female terminal 5 is provided slidable the fastening member 8 for tightening the female terminal 5 when connected to the male terminal member, to fasten the male terminal member.

Since in this embodiment the stranded conductor 3 of the cable 6 is converted into the terminal to form the female terminal cable 1, no conventional terminal used is required, and the connection portion of the conductors (the connection portion of the female terminal 5 and the male terminal 11 or the conductive pin 16) can therefore be smaller than the outside diameter of the cable 6, thus ensuring the size reduction of the connection portion.

Also, because of no terminal required, it can be ensured that the number of parts is reduced, thereby allowing a reduction in production cost. Further, reduction in the size and the number of parts can ensure the weight reduction of the conductor connection structure.

Also, because of no terminal required, the increase of the connection resistance caused in the connection portion of the stranded conductor 3 and the terminal, and therefore heat generation in the connection portion can be inhibited.

Further, since the slidable fastening member 8 is provided around the perimeter of the female terminal 5 to tighten the female terminal 5 only when connected to the male terminal member, the wear in the contact portion caused by the insertion/removal of the male terminal member can be inhibited, and the male terminal 11 can securely be fixed into the female terminal 5. This can realize the conductor connection structure whose connection portion is not adversely affected by vibration, and whose contact portion is not worn during insertion/removal. Thus, the conductor connection structure is suitable for electric cables used in a vibrational environment, such as vehicles.

Also, since in this embodiment, the cylindrical portion 5*a* of the female terminal 5 is formed to be widened toward its end, the wear in the contact portion caused by the insertion/removal of the male terminal member can be inhibited, and the male terminal member can easily be inserted into the hollow portion 5*b* of the female terminal 5.

Further, since in this embodiment, the inner wall 8*a* of the fastening member 8 is formed in a tapered shape which is widened toward the end of the female terminal 5, the fastening member 8 can easily be slid during fastening, and the cylindrical portion 5*a* can easily be diametrically compressed to fasten the male terminal member into the female terminal 5.

The other embodiments of the invention are described below.

Second Embodiment

Figure 6:
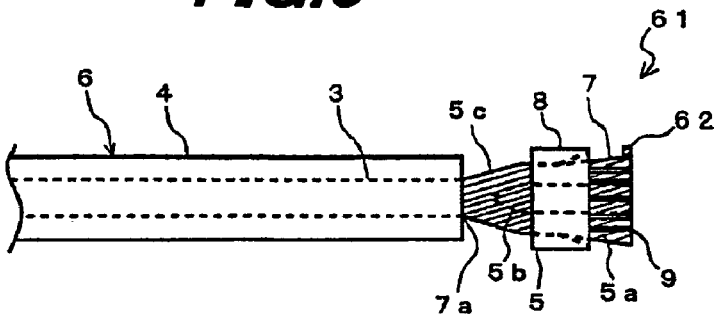
FIG. 6 is a front view showing a female terminal cable used in a conductor connection structure in a second embodiment according to the invention.

Referring to FIG. 6, a female terminal cable 61 is formed with a stopper 62 at the end of the cylindrical portion 5*a* of the female terminal 5 for preventing the fastening member 8 from slipping, in the female terminal cable 1 of FIGS. 1A and 1B. The stopper 62 is provided to protrude diametrically outward from the end of the cylindrical portion 5*a*.

The stopper 62 may be formed by bending a portion of the end of the cylindrical portion 5*a* when widening the end of the cylindrical portion 5*a* into the wide-end shape after or simultaneously with the pressure molding of the female terminal 5.

Although FIG. 6 shows the stopper 62 formed at the portion of the end of the cylindrical portion 5*a*, the stopper 62 may be formed around the entire perimeter of the end of cylindrical portion 5*a*.

The stopper 62 can prevent the fastening member 8 from accidentally slipping out from the female terminal 5 when sliding the fastening member 8 during the fastening.

Although the above embodiments have explained the example of forming the cylindrical portion 5*a*, the female terminal shape is not limited thereto. For example, when using a male terminal member with a rectangular cross-sectional terminal portion (or a conductor pin), the protruding portion 7 of the stranded conductor 3 may be split into two to be molded into a clevis shape to form two rectangular traverse-cross-sectional terminal portions, and provide a square cylindrical fastening member 8 around both of the terminal portions. In this case, both of the terminal portions may be formed to be widened outward, to thereby inhibit wear in the contact portion caused by the insertion/removal of the male terminal member.

Third Embodiment

Figure 7:
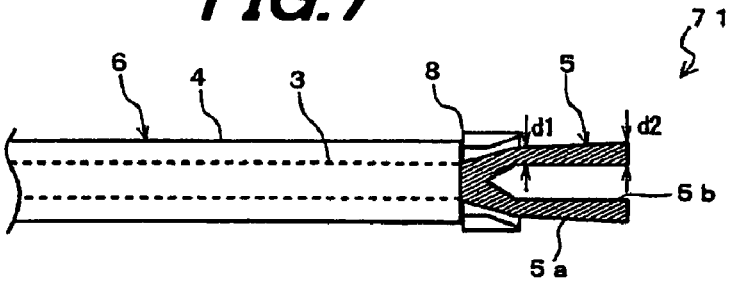
FIG. 7 is a front view showing a female terminal cable used in a conductor connection structure in a third embodiment according to the invention.

Although in the above embodiments the thickness of the stranded conductor 3 in the cylindrical portion 5*a* of the female terminal 5 is constant, the thickness of the stranded conductor 3 in the cylindrical portion 5*a* of the female terminal 5 may be formed in a tapered shape, which is widened toward the end of the cylindrical portion 5*a*, as shown in FIG. 7. Namely, the cylindrical portion 5*a* of the female terminal 5 may be formed in a tapered shape, so that the thickness d2 of the end of the cylindrical portion 5*a* is greater than the tapered base 5*c*-side thickness dl of the cylindrical portion 5*a*.

In this case, forming the diameter of hollow portion 5*b* slightly greater than the outside diameter of the terminal portion 11*a* of the male terminal 11 can inhibit wear in the contact portion caused by the insertion/removal of the male terminal member. When forming a female terminal cable 71 in FIG. 7, a female terminal mold with a female terminal mold hole formed in a tapered shape is used, so that the female terminal 5 may be formed by pressure molding.

The conductor connection structure of the invention is used in, for example, large-current wire harness connectors for use in hybrid vehicles, electric vehicles, and the like. When applying the conductor connection structure of the invention to the large-current wire harness connectors, the female connector is provided to cover the female terminal 5 of the female terminal cable 1 (or 61), and the male connector is provided to cover the male terminal 11 of the male terminal cable 10, and when mating the female connector and the male connector, the male terminal 11 may be inserted into the female terminal 5. Also, to slide the fastening member 8, the female connector may be provided with a lock mechanism.

Herein, the invention has been described as being applied to a large-current wire harness connector for use in hybrid vehicles, electric vehicles, and the like, but is not limited thereto.

It should be appreciated that the invention is not limited to the above embodiments, but may be variously altered within the scope not departing from the gist of the invention.

Fourth Embodiment

Below is described a conductor connection structure in the fourth embodiment according to the invention, referring to FIGS. 8A-8F, 9A, 9B, and 10.

A conductor connection structure of the invention is for connecting a cable to a male terminal member (another cable or a pin terminal), and is used in, for example, large-current wire harness connectors for use in hybrid vehicles, electric vehicles, and the like.

Female Terminal Cable 101

Figure 8A:
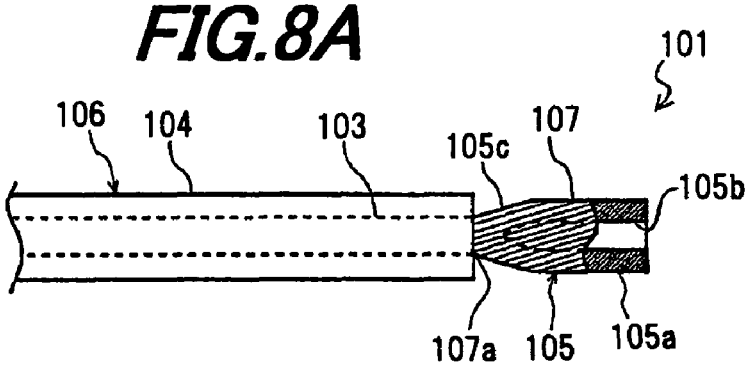
FIG. 8A is a front view showing a female terminal cable used in a conductor connection structure in a fourth embodiment according to the invention.
Figure 8B:
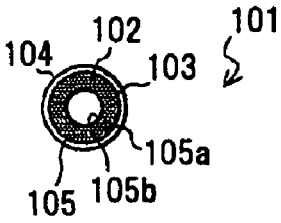
FIG. 8B is a side end face view showing the female terminal cable of FIG. 8A.

FIG. 8A is a front view showing a female terminal cable used in the conductor connection structure in the first embodiment. FIG. 8B is a side end face view showing the female terminal cable of FIG. 8A.

As shown in FIGS. 8A and 8B, a female terminal cable 101 comprises a cable 106, and a female terminal 105 formed integrally with an end of the cable 106.

Cable 106

The cable 106 comprises a stranded conductor 103 comprising twisted plural wire conductors 102, and an insulating layer 104 formed around the perimeter of the stranded conductor 103.

It is desirable that the stranded conductor 103 of the cable 106 comprises at least 20, preferably 50 or more twisted wire conductors 102. The wire conductors 102 to use may have a diameter ø of substantially 0.1-1.0 mm, for example. It is desirable that the stranded conductor 103 have a diameter of 4.0-10 mm, for example, and that the entire stranded conductor 103 is rigid.

The wire conductors 102 are formed of copper, a copper alloy, aluminum, an aluminum alloy, or the like. The insulating layer 104 is formed of a rubber material, or a plastic material. Although in FIGS. 1A and 1B, the insulating layer 104 is formed by one layer, it may have a multilayer structure.

Female Terminal 105

The female terminal 105 is for inserting and mating a later-described male terminal member, and is formed of a protruding portion 107 of the stranded conductor 103. The female terminal 105 comprises a cylindrical portion 105*a* at an end of the protruding portion 107 cylindrically molded by diametrically widening the protruding portion 107 of the stranded conductor 103, and a tapered base 105*c* between a base end 107*a* of the protruding portion 107 at the boundary between the protruding portion 107 and the insulating layer 104, and the cylindrical portion 105*a*. The tapered base 105*c* is diametrically and gradually widened from the base end 107*a*. At the end of the female terminal 105 is formed a hollow portion 105*b* enclosed with the cylindrical portion 105*a*.

Female Terminal Cable 101-Producing Method

Figure 9A:
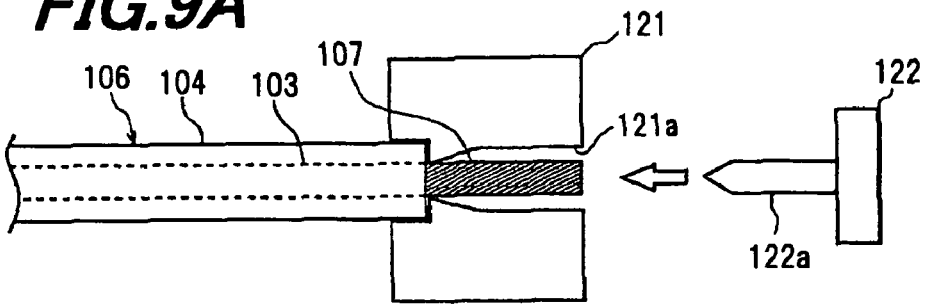
FIGS. 9A and 9B are diagrams showing a process for producing the female terminal cable of FIG. 8A.
Figure 9B:
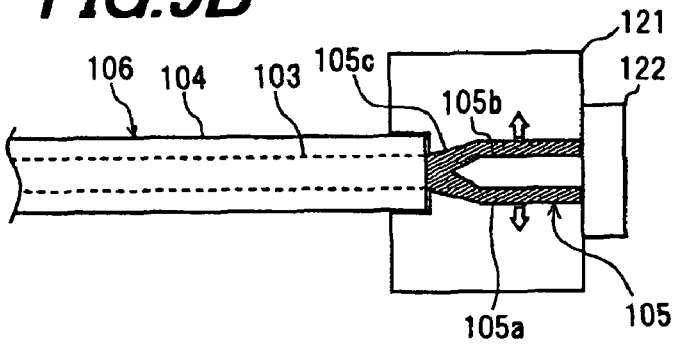

Referring to FIGS. 9A and 9B, the female terminal 105 is formed by widening outward and pressure-molding the plural wire conductors 102.

Referring to FIG. 9A, at an end of the cable 106, the stranded conductor 103 is first caused to protrude from the insulating layer 104 to form the protruding portion 107. Around the protruding portion 107 is arranged a female terminal mold 121. The length of the protruding portion 107 of the stranded conductor 103 protruding from the end of the cable 106 is 15 to 20 mm, for example.

The female terminal mold 121 is formed with a female terminal mold hole 121*a* in the same shape as the shape of the female terminal 105 (the cylindrical portion 105*a* and the tapered base 105*c*) to mold. In the female terminal mold hole 121*a* is arranged the protruding portion 107.

A pusher member 122 with a pointed protrusion 122*a* is subsequently pushed into the end of the protruding portion 107, to widen the center of the end of the protruding portion 107 to make the protruding portion 107 hollow, and cause the pressure between the female terminal mold 121 and the pusher member 122 to mold the protruding portion 107, to form the female terminal 105 including the hollow portion 105*b* in the protruding portion 107. The pointed protrusion 122*a* of the pusher member 122 is formed to be sized equal to or smaller than a later-described male terminal member outside diameter (i.e., an outside diameter of its portion to be inserted into and mated to the hollow portion 105*b*).

The formation of the female terminal 105 is followed by removal of the female terminal mold 121 and the pusher member 122, resulting in the female terminal cable 101, as shown in FIGS. 8A and 8B. The outside diameter ø of the cylindrical portion 105*a* of female terminal 105 is 10 mm, for example, its inside diameter is ø 5 mm, for example, and its length (mating length) in the axial direction of the hollow portion 5*b* is 10 mm, for example.

Also, to reinforce the mechanical strength of the female terminal 105, a conductive metal may be adhered to the female terminal 105. As the conductive metal to adhere, there is nickel, a nickel alloy, silver, a silver alloy, tin, a tin alloy (e.g., solder), gold, a gold alloy, platinum, a platinum alloy, copper, a copper alloy, aluminum, an aluminum alloy, zinc, a zinc alloy, or the like.

When adhering the conductive metal to the female terminal 105, after the formation of the female terminal 105, the female terminal 105 is immersed in the conductive metal melt to adhere the conductive metal. Although herein has been explained the example of adhering the conductive metal after forming the female terminal 105, the conductive metal may first be adhered to the protruding portion 107 of the stranded conductor 103, and the female terminal 105 may then be formed by pressure molding.

Male Terminal Member

Figure 8C:
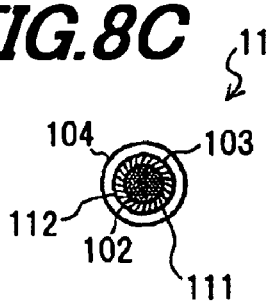
FIG. 8C is a side end face view showing a male terminal cable used in the conductor connection structure in the fourth embodiment.
Figure 8D:
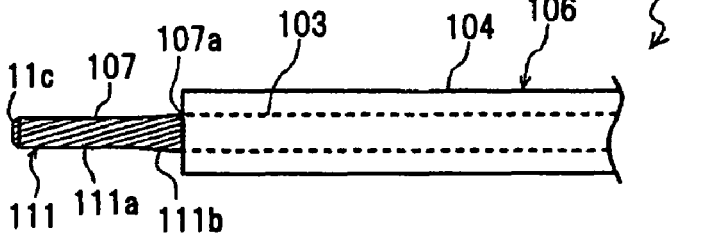
FIG. 8D is a front view showing the male terminal cable of FIG. 8C.
Figure 8E:
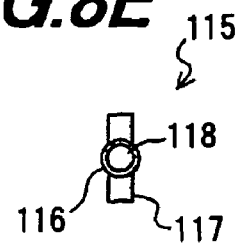
FIG. 8E is a side end face view showing a pin terminal used in the conductor connection structure in the fourth embodiment.
Figure 8F:
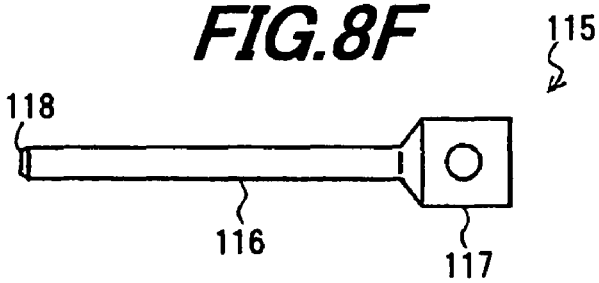
FIG. 8F is a front view showing the pin terminal of FIG. 8E.

A male terminal member to be connected to the female terminal 105 of the female terminal cable 101 of FIGS. 8A and 8B uses a male terminal cable 110 as shown in FIGS. 8C and 8D, or a pin terminal 115 as shown in FIGS. 8E and 8F.

The male terminal cable 110 shown in FIGS. 8C and 8D comprises a cable 106 including a stranded conductor 103 comprising twisted plural wire conductors 102, and an insulating layer 104 formed around the perimeter of the stranded conductor 103, and a male terminal 111 formed by molding the stranded conductor 103 at an end of the cable 106. Although herein is explained the cable 106 of the male terminal cable 110 using the same as that of the female terminal cable 101, the cable 106 may be different therefrom in dimensions.

The male terminal 111 is formed with the protruding portion 107 formed by causing the stranded conductor 103 to protrude from the insulating layer 104 at the end of the cable 106, and diametrically compressing the end of the protruding portion 107. The length of the protruding portion 107 of the stranded conductor 103 protruding from the end of the cable 106 is 15 to 20 mm, for example.

The male terminal 111 comprises a terminal portion 111*a* at a diametrically compressed end of the protruding portion 107, and a tapered base 111*b* between a base end 107*a* of the protruding portion 107 at the boundary between the protruding portion 107 and the insulating layer 104, and the terminal portion 111*a*. The tapered base 111*b* is diametrically and gradually compressed from the base end 107*a*. Also at the end of the terminal portion 111*a* of the male terminal 111 is formed a tapered terminal end 111*c*, which is diametrically compressed toward the end of the male terminal 111, to facilitate the insertion of the male terminal 111 into the female terminal 105. The outside diameter a of the terminal portion 111*a* of the male terminal 111 is 5 mm, for example.

Conductor Connection Structure

Figure 10:
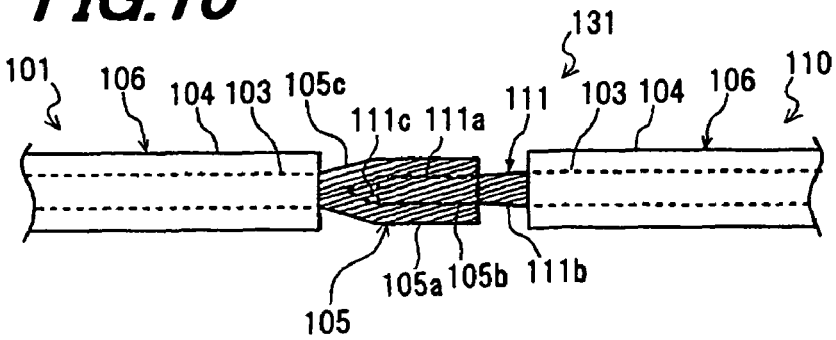
FIG. 10 is a side view showing the conductor connection structure in the fourth embodiment.

Referring to FIG. 10, when the male terminal cable 110 is used as the male terminal member, the terminal portion 111*a* of the male terminal 111 of the male terminal cable 110 is inserted and mated into the hollow portion 105*b* of the female terminal 105 of the female terminal cable 101. This results in a conductor connection structure 131 of the invention electrically connecting the stranded conductor 103 of the female terminal cable 101 and the stranded conductor 103 of the male terminal cable 110.

The connection portion of the female terminal cable 101 and the male terminal cable 110 may be covered with a casing or the like, to protect and fix the connection portion. Specifically, a female connector (not shown) is provided to cover the female terminal 105 of the female terminal cable 101, and a male connector (not shown) is provided to cover the male terminal 111 of the male terminal cable 110, and when connecting the female terminal cable 101 and the male terminal cable 110, the female connector and the male connector may be mated, to thereby protect and fix the connection portion.

The pin terminal 115 shown in FIGS. 8E and 8F comprises a conductive pin 116 to mate to the female terminal of the female terminal cable 101, and a terminal portion 117 for an external electric equipment to connect to the external electric equipment. Also at the end of the conductive pin 116 is formed a tapered terminal end 118, which is diametrically compressed toward the end of the conductive pin 116, to facilitate the insertion of the pin terminal 115 into the female terminal 105. The pin terminal 115 is formed of copper, a copper alloy, aluminum, or an aluminum alloy, for example.

When using the pin terminal 115 as the male terminal member, the conductive pin 116 of the pin terminal 115 is inserted and mated into the hollow portion 105*b* of the female terminal 105 of the female terminal cable 101, for electrical connection, in the same manner as when using the male terminal cable 110.

Functions and Advantages of the Fourth Embodiment

The functions and advantages of the fourth embodiment are explained below.

In the conductor connection structure of the fourth embodiment, at an end of the cable 106 of the female terminal cable 101, the stranded conductor 103 is first caused to protrude from the insulating layer 104 to form the protruding portion 107. The protruding portion 107 is widened at the center of its end to make the protruding portion 107 hollow, and thereby form the cylindrical female terminal 105 for the male terminal member being inserted thereinto.

Since in the fourth embodiment the stranded conductor 103 of the cable 106 is converted into the terminal to form the female terminal cable 101, no conventional terminal used is required, and the connection portion of the conductors (the connection portion of the female terminal 105 and the male terminal 111 or the conductive pin 116)' can therefore be smaller than the outside diameter of the cable 106, thus ensuring the size reduction of the connection portion.

Also, because of no terminal required, it can be ensured that the number of parts is reduced, thereby allowing a reduction in production cost. Further, reduction in the size and the number of parts can ensure the weight reduction of the conductor connection structure.

Also, because of no terminal required, the increase of the connection resistance caused in the connection portion of the stranded conductor 103 and the terminal, and therefore heat generation in the connection portion can be inhibited.

Fifth Embodiment

Next is explained the fifth embodiment of the invention.

Figure 11A:
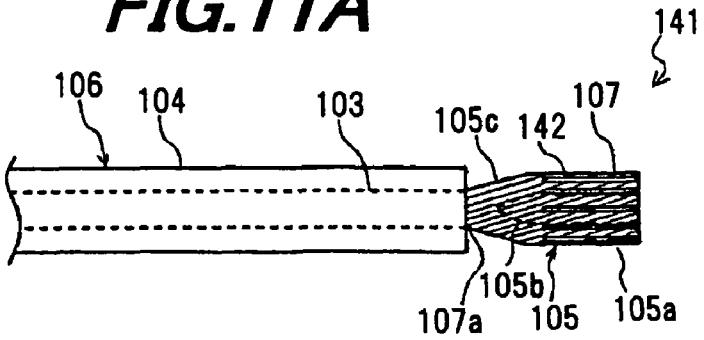
FIG. 11A is a front view showing a female terminal cable used in a conductor connection structure in a fifth embodiment according to the invention.
Figure 11B:
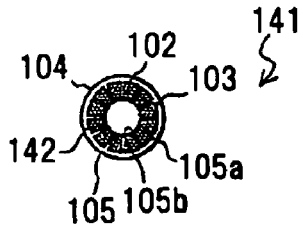
FIG. 11B is a side end face view showing the female terminal cable of FIG. 11A.

Referring to FIGS. 11A and 11B, a female terminal cable 141 used in a conductor connection structure in the fifth embodiment is constructed such that the cylindrical portion 105*a* of the female terminal 105 in the female terminal cable 101 of FIGS. 8A and 8B is formed with plural slits 142 in its axial direction, which circumferentially split the cylindrical portion 105*a*.

It is preferred to form an even number of the slits 142 to circumferentially and equally split the cylindrical portion 105*a*. This allows the respective inner surfaces of the split cylindrical portions 105*a* to be located directly opposite each other with respect to the male terminal member (or the hollow portion 105*b*), and therefore the female terminal 105 and the male terminal member to firmly mate to each other. Also, the slits 142 are located directly opposite each other with respect to the male terminal member (or the hollow portion 105*b*), and can therefore inhibit the male terminal member from fitting into the slit 142 and deforming the female terminal 105.

In forming the slits 142, a pusher member with slit formation protrusions (e.g., star-shaped transverse cross-sectional protrusions) is used in the slit 142 formation portions, so that the slits 142 may be formed simultaneously when the female terminal 105 is formed by pressure-molding the stranded conductor 103 (see FIGS. 9A and 9B). Although the stranded conductor 103 comprises twisted plural wire conductors 102, because the protruding portion of the stranded conductor 103 is short and substantially straight, the slits 142 can be molded by inserting into the protruding portion of the stranded conductor 103 the pusher member formed with the protrusions.

When adhering the conductive metal to the female terminal 105, after the pressure molding of the female terminal 105, with the pusher member pushed in, the female terminal 105 is immersed in the conductive metal melt to adhere the conductive metal. This may be followed by removal of the pusher member.

Figure 11C:
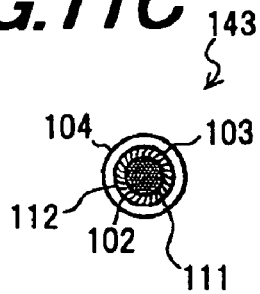
FIG. 11C is a side end face view showing a male terminal cable used in the conductor connection structure in the fifth embodiment.
Figure 11D:
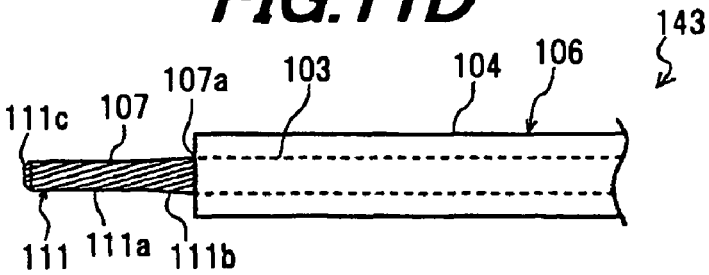
FIG. 11D is a front view showing the male terminal cable of FIG. 11C.
Figure 11E:
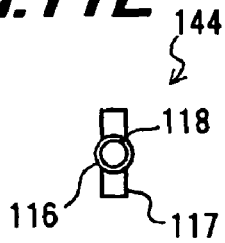
FIG. 11E is a side end face view showing a pin terminal used in the conductor connection structure in the fifth embodiment.
Figure 11F:
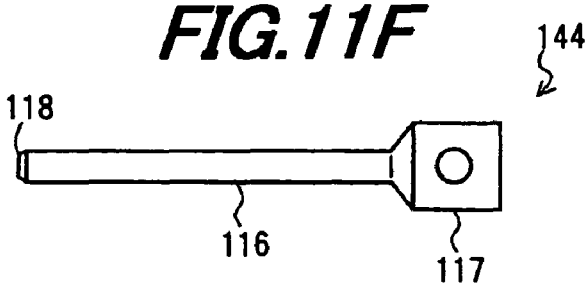
FIG. 11F is a front view showing the pin terminal of FIG. 11E.

A male terminal member to be connected to the female terminal 105 of the female terminal cable 141 uses a male terminal cable 143 as shown in FIGS. 11C and 11D, or a pin terminal 144 as shown in FIGS. 11E and 11F. The male terminal cable 143 is the same as the male terminal cable 110 of FIGS. 8C and 8D, and the pin terminal 144 is the same as the pin terminal 115 as shown in FIGS. 8E and 8F.

Forming the slits 142 allows the female terminal 105 to have a spring structure, and when inserting and mating the male terminal 111 of the male terminal cable 143, or the conductor pin 116 of the pin terminal 144 into the female terminal 105, the male terminal 111 or the conductor pin 116 to be firmly held in the female terminal 105. Thus, the contact resistance can be inhibited from being increased due to a gap being formed between the female terminal 105 and the male terminal 111 or conductor pin 116, and heat generation due to the increase of the contact resistance can be inhibited.

Sixth Embodiment

Next is explained the sixth embodiment of the invention.

Figure 12A:
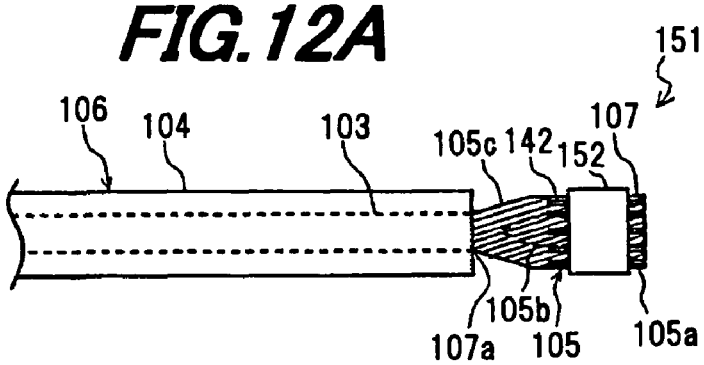
FIG. 12A is a front view showing a female terminal cable used in a conductor connection structure in a sixth embodiment according to the invention.
Figure 12B:
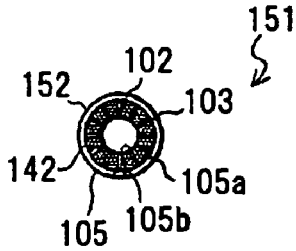
FIG. 12B is a side end face view showing the female terminal cable of FIG. 12A.

Referring to FIGS. 12A and 12B, a female terminal cable 151 used in a conductor connection structure in the sixth embodiment is constructed such that the female terminal 105 in the female terminal cable 141 of FIGS. 11A and 11B is around there provided with a C-shaped-traverse-cross-sectional spring 152 for inhibiting the cylindrical portion 105*a* of the female terminal 105 from being widened outward when inserting a male terminal member.

It is desirable that the spring 152 use a high-conductivity material. To prevent hetero-metal contact corrosion, the spring 152 may use the same material as the stranded conductor 103. For example, where the stranded conductor 103 is formed of copper or a copper alloy, the spring 152 may use copper or a copper alloy. Where the stranded conductor 103 is formed of aluminum or an aluminum alloy, the spring 152 may use aluminum or an aluminum alloy.

Also, because its use in an environment of large amounts of heat generated, as in large current cables and the like, causes its spring force to be weakened and its contact resistance to be increased by stress relaxation due to heat, it is preferred that the spring 152 uses an elastic iron-based alloy, such as stainless, from the point of view of long-term maintenance of its elasticity. In this manner, the material to use as the spring 152 may be determined appropriately according to purposes of use, materials used as the stranded conductor 103, etc.

Figure 12C:
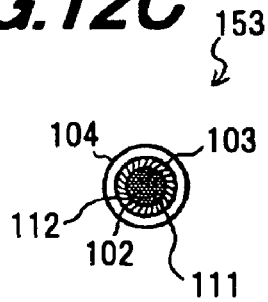
FIG. 12C is a side end face view showing a male terminal cable used in the conductor connection structure in the sixth embodiment.
Figure 12D:
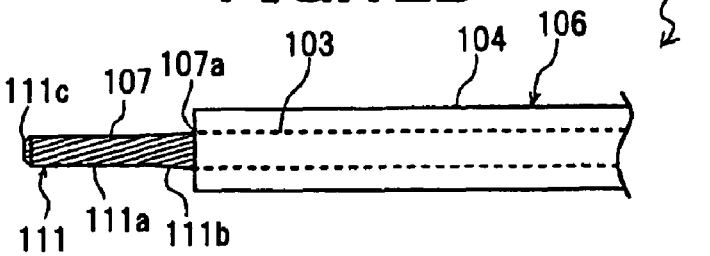
FIG. 12D is a front view showing the male terminal cable of FIG. 12C.
Figure 12E:
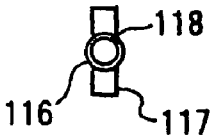
FIG. 12E is a side end face view showing a pin terminal used in the conductor connection structure in the sixth embodiment.
Figure 12F:
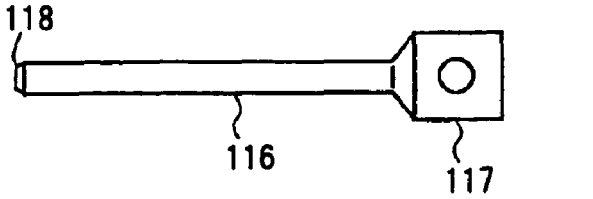
FIG. 12F is a front view showing the pin terminal of FIG. 12E.

A male terminal member to be connected to the female terminal 105 of the female terminal cable 151 uses a male terminal cable 153 as shown in FIGS. 12C and 12D, or a pin terminal 154 as shown in FIGS. 12E and 12F. The male terminal cable 153 is the same as the male terminal cable 110 of FIGS. 8C and 8D, and the pin terminal 154 is the same as the pin terminal 115 as shown in FIGS. 8E and 8F.

The spring 152 can reinforce the spring structure of female terminal 105, so that the male terminal 111 or the conductor pin 116 can be more firmly held in the female terminal 105. Thus, the contact resistance can be more inhibited.

Also, the male terminal 111 or the conductor pin 116 can more firmly be fixed to female terminal 105 by the spring 152, so that no casing or the like is required to fix the connection portion. Thus, the casing may be omitted, but the connection portion may instead be wrapped with an insulating tape or the like, to protect the connection portion.

Seventh Embodiment

Next is explained the seventh embodiment of the invention.

Figure 13A:
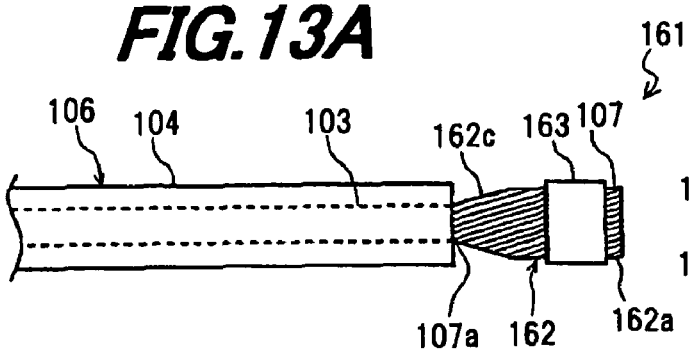
FIG. 13A is a front view showing a female terminal cable used in a conductor connection structure in a seventh embodiment according to the invention.
Figure 13B:
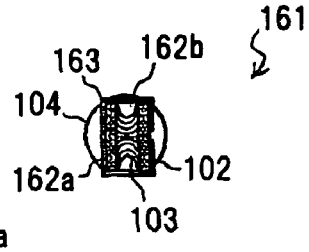
FIG. 13B is a side end face view showing the female terminal cable of FIG. 13A.

Referring to FIGS. 13A and 13B, a female terminal cable 161 used in a conductor connection structure in the seventh embodiment is formed with a female terminal 162 comprising the protruding portion 107 formed by causing the stranded conductor 103 to protrude from the insulating layer 104 at an end of the cable 106. The female terminal 162 is formed by splitting an end of the protruding portion 107 into two to be formed into a clevis shape, to insert a male terminal member into the protruding portion 107.

The female terminal 162 comprises two terminal portions 162*a* at the end of the protruding portion 107 of the stranded conductor 103 split into two to be formed in a clevis shape, and a tapered base 162*c* between a base end 107*a* of the protruding portion 107 at the boundary between the protruding portion 107 and the insulating layer 104, and the terminal portions 162*a*. The tapered base 162*c* is widened from the base end 107*a*. At the end of the female terminal 162 is formed a hollow portion 162*b* interposed between both of the terminal portions 162*a*. The terminal portions 162*a* each are formed in a rectangular transverse cross-sectional shape.

Around the female terminal 162 is provided a substantially rectangular-traverse-cross-sectional spring 163 for inhibiting the terminal portions 162*a* of the female terminal 162 from being widened outward when inserting a male terminal member into the hollow portion 162*b*.

Figure 13C:
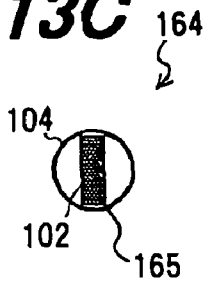
FIG. 13C is a side end face view showing a male terminal cable used in the conductor connection structure in the seventh embodiment.
Figure 13D:
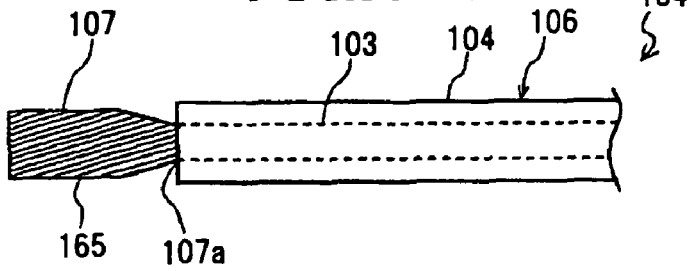
FIG. 13D is a front view showing the male terminal cable of FIG. 13C.
Figure 13E:
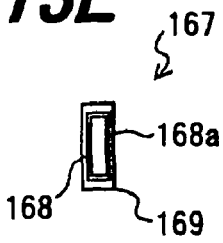
FIG. 13E is a side end face view showing a pin terminal used in the conductor connection structure in the seventh embodiment.
Figure 13F:
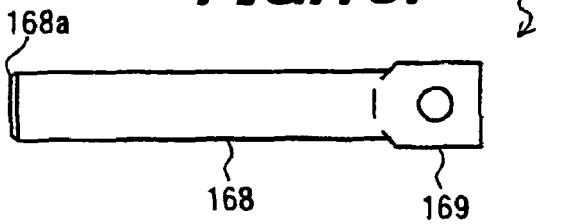
FIG. 13F is a front view showing the pin terminal of FIG. 13E.

A male terminal member to be connected to the female terminal 162 of the female terminal cable 161 uses a male terminal cable 164 as shown in FIGS. 13C and 13D, or a pin terminal 167 as shown in FIGS. 13E and 13F.

The male terminal cable 164 shown in FIGS. 13C and 13D is formed with a male terminal 165 by molding the stranded conductor 103 at an end of the cable 106. The male terminal 165 is formed with the protruding portion 107 formed by causing the stranded conductor 103 to protrude from the insulating layer 104 at the end of the cable 106, and molded to have a rectangular traverse cross-section at its end. Although not shown in FIG. 13D, the end of the male terminal 165 may be formed with a tapered terminal end, which is diametrically compressed toward the end of the male terminal 165, to facilitate the insertion of the male terminal 165 into the female terminal 162.

The pin terminal 167 shown in FIGS. 13E and 13F comprises a conductive pin 168 to insert and mate into the hollow portion 162*b* of the female terminal 162 of the female terminal cable 161, and a terminal portion 169 for an external electric equipment formed integrally with the conductive pin 168 and to connect to the external electric equipment. Also at the end of the conductive pin 168 is formed a tapered terminal end 168*a*, which is diametrically compressed toward the end of the conductive pin 168, to facilitate the insertion of the conductive pin 168 into the female terminal 162.

The seventh embodiment allows the female terminal 162 to be reinforced by the spring 163 in the same manner as the sixth embodiment, and therefore the male terminal 165 or the conductor pin 168 to be more firmly held in and fixed to the female terminal 162. Thus, the contact resistance can be more inhibited.

Also, even when the male terminal 165 or the conductor pin 168 is rectangular in traverse cross section, it may be applied to the case of an existing rectangular male terminal (pin terminal, etc.).

Figure 14A:
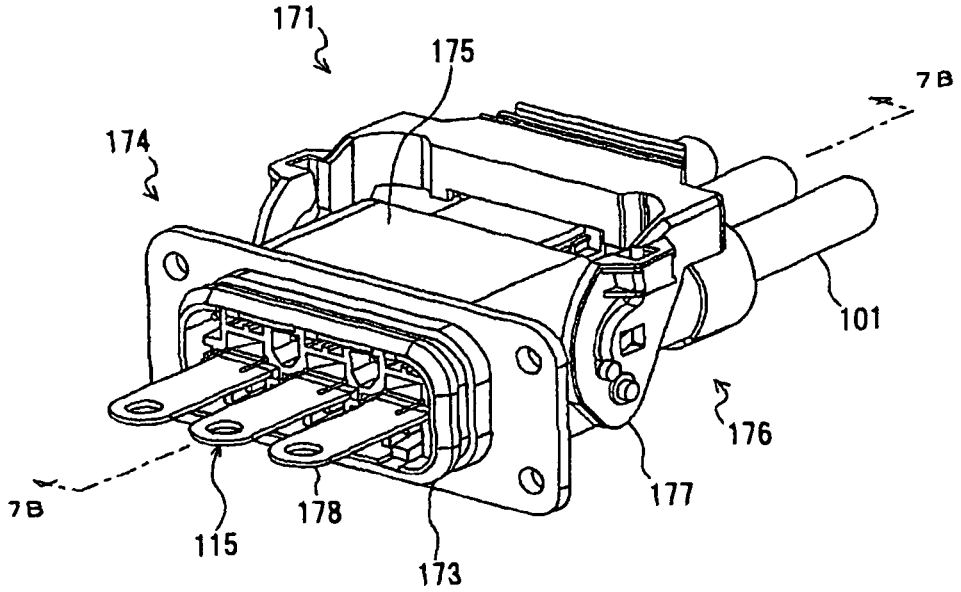
FIG. 14A is a perspective view showing one example of a connector using the conductor connection structure in the fourth embodiment.
Figure 14B:
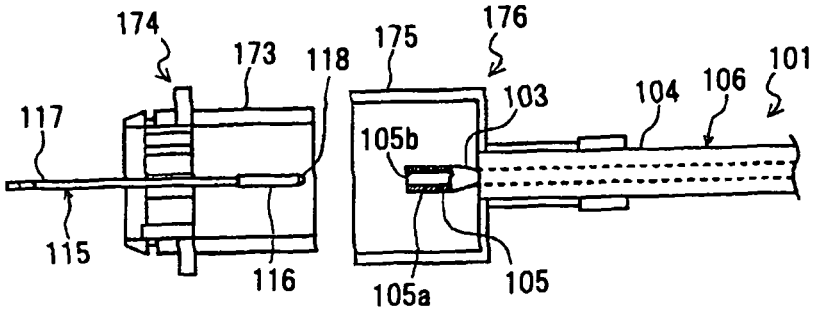
FIG. 14B is a cross-sectional view showing the connector taken along line 14B-14B of FIG. 14A.

The conductor connection structure of the invention is used in a large-current wire harness connector for use in hybrid vehicles, electric vehicles, and the like. FIGS. 14A and 14B show one example of a large-current wire harness connector using the conductor connection structure of the invention.

As shown in FIGS. 14A and 14B, a connector 171 comprises a male connector 174 with a male housing 173 for accommodating the pin terminal 115 of FIGS. 8E and 8F, and a female connector 176 with a female housing 175 for accommodating the female terminal cable 101 of FIGS. 8A and 8B. The female housing 175 is provided with a rotary lever 177. The male connector 174 is inserted into the female connector 176 and the lever 177 is rotated, thereby allowing the male connector 174 and the female connector 176 to be mated and fixed.

In the connector 171, the lever 177 is rotated to mate the male connector 174 and the female connector 176, to insert and mate the conductor pin 116 of the pin terminal 115 into the hollow portion 105*b* of the female terminal 105, to electrically connect the pin terminal 115 and the stranded conductor 103 of the female terminal cable 101.

Since the conductor connection structure of the invention uses no terminal and can therefore make the connection portion small, the entire connector 171 can be reduced in size. Because of limited wiring space in hybrid vehicles or electric vehicles, connectors are required to be reduced in size. However, the use of the conductor connection structure of the invention allows the wiring space to be effectively utilized, and therefore the production cost to be reduced.

Although FIGS. 14A and 14B have exemplified the use of the female terminal cable 101 of FIGS. 8A and 8B, the same applies to the use of the female terminal cable 141 of FIGS. 8A and 8B, or the female terminal cable 151 of FIGS. 9A and 9B. Also, when using a pin terminal (e.g., the pin terminal 167 of FIGS. 13E and 13F) with a rectangular conductive pin, the female terminal cable 161 of FIGS. 13A and 13B may be used.

Herein, the invention has been described as being applied to a large-current wire harness connector 171 for use in hybrid vehicles, electric vehicles, and the like, but is not limited thereto.

It should be appreciated that the invention is not limited to the above embodiments, but may be variously altered within the scope not departing from the gist of the invention.

What is claimed is:

1. A conductor connection comprising:

a cable comprising a stranded conductor comprising twisted plural wire conductors, and an insulating layer formed around the perimeter of the stranded conductor, the cable being connected to a male terminal member;

a female terminal comprising a protruding portion formed by causing the stranded conductor to protrude from the insulating layer at an end of the cable, the female terminal being formed in a cylindrical shape by widening the center of an end of the protruding portion to make the protruding portion hollow, to insert the male terminal member into the protruding portion; and a fastening member slidably provided around the perimeter of the female terminal, to tighten the female terminal when connected to the male terminal member, to fasten the male terminal member;

wherein the female terminal includes a cylindrical portion at the end of the protruding portion cylindrically molded by diametrically widening the stranded conductor at the end of the protruding portion, and the cylindrical portion is formed with plural slits in its axial direction, which circumferentially split the cylindrical portion.

2. The conductor connection structure according to claim 1, wherein an even number of the slits are formed to circumferentially and equally split the cylindrical portion.

3. The conductor connection structure according to claim 1, wherein the cylindrical portion of the female terminal is formed to be widened toward its end.

4. The conductor connection structure according to claim 1, wherein the inner wall of the fastening member is formed in a tapered shape, which is widened toward the end of the female terminal.

5. The conductor connection structure according to claim 1, wherein the female terminal is formed by arranging a female terminal mold around the protruding portion, and pushing a pusher member with a pointed protrusion into the end of the protruding portion to widen the plural wire conductors of the protruding portion outward, so that the female terminal is molded by the pressure between the female terminal mold and the pusher member.

6. The conductor connection structure according to claim 5, wherein the cylindrical portion of the female terminal is formed to be widened toward its end by widening its end outward after the pressure molding.

7. The conductor connection structure according to claim 1, wherein the female terminal is formed by widening outward and pressure molding the plural wire conductors of the protruding portion, and subsequently adhering a conductive metal.

8. The conductor connection structure according to claim 1 wherein the female terminal is formed by adhering a conductive metal to the plural wire conductors at the end of the stranded conductor, and subsequently widening outward and pressure molding the plural wire conductors.

9. The conductor connection structure according to claim 1, wherein the fastening member is formed of the same material as the stranded conductor, or stainless.

10. The conductor connection structure according to claim 1, wherein the male terminal member comprises a pin terminal.

11. A conductor connection structure comprising:

a cable comprising a stranded conductor comprising twisted plural wire conductors, and an insulating layer formed around the perimeter of the stranded conductor, the cable being connected to a male terminal member;

a female terminal comprising a protruding portion formed by causing the stranded conductor to protrude from the insulating layer at an end of the cable, the female terminal being formed in a cylindrical shape by widening the center of an end of the protruding portion to make the protruding portion hollow, to insert the male terminal member into the protruding portion; and a fastening member slidably provided around the perimeter of the female terminal, to tighten the female terminal when connected to the male terminal member, to fasten the male terminal member, wherein the male terminal member comprises a cable comprising a stranded conductor comprising twisted plural wire conductors, and an insulating layer formed around the perimeter of the stranded conductor, and a male terminal with a protruding portion formed by causing the stranded conductor to protrude from the insulating layer at the end of the cable, and diametrically compressing the end of the protruding portion, to mate the protruding portion to the female terminal.

12. A conductor connection structure comprising:

a cable comprising a stranded conductor comprising twisted plural wire conductors, and an insulating layer formed around the perimeter of the stranded conductor, the cable being connected to a male terminal member; and a female terminal comprising a protruding portion formed by causing the stranded conductor to protrude from the insulating layer at an end of the cable, the female terminal being formed in a cylindrical shape by widening the center of an end of the protruding portion to make the protruding portion hollow, to insert the male terminal member into the protruding portion, wherein the female terminal includes a cylindrical portion at the end of the protruding portion cylindrically molded by diametrically widening the stranded conductor at the end of the protruding portion, and the cylindrical portion is formed with plural slits in its axial direction, which circumferentially split the cylindrical portion.

13. The conductor connection structure according to claim 12, wherein the female terminal is formed by arranging a female terminal mold around the protruding portion, and pushing a pusher member with a pointed protrusion into the end of the protruding portion to widen the plural wire conductors of the protruding portion outward, so that the female terminal is molded by the pressure between the female terminal mold and the pusher member.

14. The conductor connection structure according to claim 12, wherein an even number of the slits are formed to circumferentially and equally split the cylindrical portion.

15. The conductor connection structure according to claim 12, wherein the female terminal is formed by widening outward and pressure molding the plural wire conductors of the protruding portion, and subsequently adhering a conductive metal.

16. The conductor connection structure according to claim 12, wherein the female terminal is formed by adhering a conductive metal to the plural wire conductors at the end of the stranded conductor, and subsequently widening outward and pressure molding the plural wire conductors.

17. A conductor connection structure, comprising:

a cable comprising a stranded conductor comprising twisted plural wire conductors, and an insulating layer formed around the perimeter of the stranded conductor, the cable being connected to a male terminal member; and a female terminal comprising a protruding portion formed by causing the stranded conductor to protrude from the insulating layer at an end of the cable, the female terminal being formed by splitting the protruding portion into two to be formed into a clevis shape, to insert the male terminal member into the protruding portion.

18. The conductor connection structure according to claim 17, wherein the female terminal is formed with the two clevis terminal portions, each being formed to have a rectangular cross-sectional shape.

19. The conductor connection structure according to claim 17, further comprising a spring provided around the perimeter of the female terminal to inhibit the female terminal from being widened outward when inserting the male terminal member.

20. The conductor connection structure according to claim 19, wherein the spring is formed of the same material as the stranded conductor, or stainless.

21. The conductor connection structure according to claim 17, wherein the male terminal member comprises a pin terminal.

22. The conductor connection structure according to claim 17, wherein the male terminal member comprises a cable comprising a stranded conductor comprising twisted plural wire conductors, and an insulating layer formed around the perimeter of the stranded conductor, and a male terminal with a protruding portion formed by causing the stranded conductor to protrude from the insulating layer at the end of the cable, and diametrically compressing the end of the protruding portion, to mate the protruding portion to the female terminal.

23. A conductor connection structure, comprising:

a cable comprising a stranded conductor comprising twisted plural wire conductors, and an insulating layer formed around the perimeter of the stranded conductor, the cable being connected to a male terminal member; and a female terminal comprising a protruding portion formed by causing the stranded conductor to protrude from the insulating layer at an end of the cable, the female terminal being formed in a cylindrical shape by widening the center of an end of the protruding portion to make the protruding portion hollow, to insert the male terminal member into the protruding portion, wherein the male terminal member comprises a cable comprising a stranded conductor comprising twisted plural wire conductors, and an insulating layer formed around the perimeter of the stranded conductor, and a male terminal with a protruding portion formed by causing the stranded conductor to protrude from the insulating layer at the end of the cable, and diametrically compressing the end of the protruding portion, to mate the protruding portion to the female terminal.

* * * * *